US006565742B1

(12) United States Patent
Gentry et al.

(10) Patent No.: US 6,565,742 B1
(45) **Date of Patent: *May 20, 2003**

(54) AROMATICS SEPARATION PROCESS AND METHOD OF RETROFITTING EXISTING EQUIPMENT FOR SAME

(75) Inventors: Joseph C. Gentry, Houston, TX (US); Fu-Ming Lee, Katy, TX (US)

(73) Assignee: GTC Technology Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 606 days.

(21) Appl. No.: 09/000,579

(22) Filed: Dec. 30, 1997

Related U.S. Application Data

(60) Provisional application No. 60/057,889, filed on Sep. 3, 1997.

(51) Int. Cl.[7] ..... C10G 21/00; C10G 21/06

(52) U.S. Cl. ..... 208/311; 208/313; 208/314; 208/322; 208/330; 208/339; 585/805; 585/807; 585/857; 585/864

(58) Field of Search ..... 208/311, 313, 208/314, 322, 330, 339; 585/857, 864, 805, 807

(56) References Cited

U.S. PATENT DOCUMENTS

| | | | | |
|---|---|---|---|---|
| 2,644,467 A | | 10/1953 | Cooper et al. | 202/39.5 |
| 2,842,484 A | | 7/1958 | Fleck | 202/39.5 |
| 3,114,783 A | | 12/1963 | Butler et al. | 260/674 |
| 3,338,824 A | | 8/1967 | Oliver | 208/313 |
| 3,681,202 A | | 8/1972 | Funkhouser | 203/53 |
| 3,723,256 A | | 3/1973 | Thompson | 203/43 |
| 3,816,302 A | | 6/1974 | Paret | 208/323 |
| 3,844,902 A | | 10/1974 | Vickers et al. | 203/46 |
| 3,862,254 A | | 1/1975 | Eisenlohr et al. | 260/674 |
| 3,996,305 A | | 12/1976 | Berger | 260/672 |
| 4,053,369 A | | 10/1977 | Cines | 203/52 |
| 4,058,454 A | * | 11/1977 | Asselin | 208/321 |
| 4,081,355 A | * | 3/1978 | Preusser et al. | 208/313 |
| 4,085,158 A | * | 4/1978 | Dixson et al. | 260/680 |
| 4,401,517 A | | 8/1983 | Lee | 203/53 |
| 5,139,651 A | | 8/1992 | Forte | 208/334 |
| 5,176,821 A | | 1/1993 | Forte | 208/313 |
| 5,191,152 A | | 3/1993 | Forte | 585/833 |
| 5,202,520 A | | 4/1993 | Forte | 585/808 |
| 5,225,072 A | | 7/1993 | Vidueira | 208/313 |
| 5,310,480 A | | 5/1994 | Vidueira | 208/313 |
| 5,336,840 A | | 8/1994 | Forte | 585/833 |
| 5,399,244 A | | 3/1995 | Gentry et al. | 203/23 |

FOREIGN PATENT DOCUMENTS

| | | |
|---|---|---|
| DE | 1468315 | 11/1968 |
| GB | 812114 | 10/1957 |
| GB | 1 309 875 | 3/1973 |

OTHER PUBLICATIONS

Deal, G.H., Jr. et al., "A Better Way to Extract Aromatics," Sep. 1959, Petroleum Refiner, vol. 38, No. 9, pp. 185–192.
Beardmore, F.S. and Kosters, W.C.G., "Application of Sulpholane in UDEX Units," Jan. 1963, Journal of the Institute of Petroleum, vol. 49, No. 469, pp. 1–7.
Lee, Fu–Ming, "Use of Organic Sulfones as the Extractive Distillation Solvent for Aromatics Recovery," 1986, Ind. Eng. Chem. Process Des. Dev., vol. 25, No. 4, pp. 949–957.
Lee, Fu–Ming, "Two–Liquid–Phase Extractive Distillation for Aromatics Recovery," 1987, Ind. Eng. Chem. Res., vol. 26, No. 3, pp. 564–573.
Lee, Fu–Ming and Coombs, Daniel M., "Two–Liquid–Phase Extractive Distillation for Upgrading the Octane Number of the Catalytically Cracked Gasoline," 1988, Ind. Eng. Chem. Res., vol. 27, No. 1, pp. 118–123.
Todd, Barbara A. and Lee, Fu–Ming, "Two Liquid Phase in Extractive Distillation for Aromatic Recovery," 1993, presentation at AIChE Summer National Meeting in Seattle, WA.

* cited by examiner

*Primary Examiner*—Walter D. Griffin
(74) *Attorney, Agent, or Firm*—Jenkens & Gilchrist A Professional Corporation

(57) ABSTRACT

An improved process for the recovery of aromatic compounds from a mixture containing aromatic and non-aromatic compounds and method for retrofitting existing equipment for the same is provided. The improved process comprises the steps of recovering aromatic compounds via parallel operation of a hybrid extractive distillation/liquid-liquid extractor operation and variations thereof. Methods of quickly and economically retrofitting existing recovery process equipment for use with the improved aromatic recovery process are also disclosed.

19 Claims, 10 Drawing Sheets

AROMATICS SEPARATION PROCESS AND METHOD OF RETROFITTING EXISTING EQUIPMENT FOR SAME

RELATED APPLICATION

This application claims the benefit of U.S. Provisional Application No. 60/057,889, filed Sep. 3, 1997, which is incorporated herein by reference in its entirety for all purposes.

FIELD OF INVENTION

The present invention relates to chemical separation processes, and, more specifically, to an improved process for separation of aromatic compounds from mixtures of aromatic and non-aromatic compounds and methods for retrofitting existing equipment for same.

BACKGROUND OF THE INVENTION

Aromatic petrochemicals, such as benzene, toluene and xylenes (collectively, "BTX"), serve as important building blocks for a variety of plastics, foams and fibers. Traditionally, these fundamental compounds have been produced via catalytic reformation of naphtha or through steam cracking of naphtha or gas oils, producing streams such as reformate and pyrolysis gasoline. BTX derived from such traditional methods typically include substantial amounts of non-aromatic compounds having similar boiling points, effectively precluding simple distillation as a means of separation of the aromatic from the non-aromatic.

Accordingly, a variety of extraction techniques have been developed in an effort to separate aromatic compounds from non-aromatic ones. Such prior art extraction techniques typically involve the use of solvents which exhibit a higher affinity for the aromatic compounds, selectively extracting the aromatic compounds from the mixture of aromatic and non-aromatic compounds. An example of such prior art extraction techniques is the sulfolane process developed by Shell Oil Company. The sulfolane process employs the use of tetrahydrothiophene 1,1 dioxide (or sulfolane) as a solvent and water as a co-solvent. The process uses a combination of liquid-liquid extraction and extractive stripping in a single, integrated design.

Despite its wide-spread use, the sulfolane process suffers from several disadvantages imposed by its design. For example, such process is restricted in its available production capacity. This is due to the fact that in order for liquid-liquid extraction to occur, a phase separation must take place between the solvent/extract and the raffinate material. The maximum aromatic content of the feedstock is restricted to approximately 80%–90%.

Additionally, in traditional sulfolane process designs, the range of feedstock choices is limited. This is due to the fact that existing sulfolane extraction units were constructed when feedstock was presumed to include total aromatic concentrations of from about 30%–60%. With improvements in new catalysts and the development of continuous catalytic regeneration ("CCR"), the aromatic content of reformate streams is significantly higher, exceeding the point where liquid-liquid phase separation, and hence simple extraction, can occur. One attempt to resolve this dilemma has been to artificially recycle non-aromatic or raffinate material in order to lower the total aromatic concentration and thus promote phase separation. Alternatively, a co-solvent composition can be increased in an effort to increase the solvent system selectivity. Both of these attempts to accommodate recent developments in catalysts and catalytic systems with prior art designs significantly decrease operating efficiency and unit capacity of the process.

Another drawback associated with the prior art sulfolane process is the concentration effect of undesired components present in the reflux stream. Extraction solvents have group selectivity favoring extraction of aromatics>naphthenes/olefins>paraffins and a light/heavy selectivity which favors lower carbon number components. Accordingly, the sulfolane process design was premised upon the theory that the extractive stripping operation would easily remove lighter non-aromatic compounds, which would flow as reflux to the main extractor and displace heavier aromatics.

In practice, the design produces at least two undesired effects: (1) difficulty in recovering the heavier aromatics into the extracted stream; and (2) buildup of light impurities in the extractive stripper and reflux system. The former undesired effect associated with such prior art designs is the incapacity of such designs to completely remove and recover the heaviest species of aromatic compounds within the mixed feedstock. For example, an operation using the prior art design and processing a BTX range feedstock may result in nearly complete benzene recover while losing upwards of 15% or more of the xylenes within the feedstock into the raffinate due to the lower affinity of the solvent for xylenes compared with benzene. Such results require the employment of additional recovery schemes in an effort to more completely recover the xylenes present in the feedstock.

The latter undesired effect results in significant increases in the concentration of lower carbon number components (e.g., 5 and 6 naphthenes and olefins) within the reflux stream, which can lead to product contamination of the lowest carbon numbered aromatic compounds. Attempts to cope with this problem include increased efforts by the operator to strip such undesired components into the reflux stream and/or employing a drag stream from above the aromatic product fractionator to recycle to the extraction section. Both attempts result in increased energy consumption by and reduced capacity of the system.

Thus, there remains a need for a recovery process and method for retrofitting existing recovery process equipment to improve upon prior art aromatics recovery processes, and to avoid the disadvantages described above.

SUMMARY OF THE INVENTION

In accordance with the present invention there is provided an improved process for separation of aromatic compounds from mixtures of aromatic and non-aromatic compounds and a method for retrofitting existing equipment for employing said improved process. In one aspect, the improved process for separation of the present invention includes an extractive distillation operation as a primary separation step for the recovery of aromatic compounds. This embodiment of the invention is preferably used with feedstocks containing BTX fractions, but it is noted that it can also be used with feed fractions containing between 5 and 12 carbons.

It was discovered that the prior art sulfolane process and accompanying system suffered primarily in its design and implementation with respect to three main areas: (1) the main extractor; (2) the extractive stripper; and (3) the extract recovery operation. Although other incremental improvements were made to other aspects of the prior art process, the main improvements described herein are realized in these three primary areas.

In a first embodiment of the improved separation process of the present invention, a hybrid extraction/extractive distillation system is employed. A portion of the mixed hydrocarbon feedstock is routed to a new, separate extractive distillation column ("EDC") which operates in parallel with the main extractor, extractive stripper and water-wash operations of the process. The use of an EDC allows recovery and purification of aromatic compounds to occur in a single operation. The optional use of a co-solvent further improves the recovery capability of this embodiment of the improved aromatics recovery process of the present invention.

In a second embodiment of the improved aromatic recovery process of the present invention, the hydrocarbon feedstock originates from a heartcut fractionation column ("HFC"), such as a reformate splitter column. Additional advantages of the process are realized by segregating the feedstock fractions to the extraction and extractive distillation operations. Use of a co-solvent may be practiced with this embodiment of the improved aromatics separation process of the present invention to further improve recovery of aromatic compounds from the feedstock.

In a variation of the second embodiment described above, a side cut of the feedstock including a heavier fraction is taken from the prefractionator column and processed in the EDC. The overhead portion is fed to the traditional liquid-liquid extraction portion of the system. The chief advantage associated with this variation of the second embodiment is the more complete recovery of heavier aromatic compounds, avoiding maximum aromatic limitations associated with prior art designs and more fully described above.

In a third embodiment of the improved aromatic separation process of the present invention, the hydrocarbon feedstock is routed directly to the EDC for processing. The overhead material is subsequently condensed and routed to the liquid-liquid extractor, which functions in this embodiment as a raffinate extractor. Of practical importance is the fact that this embodiment can make use of a modified extractive stripping tower as the EDC.

In further accordance with the invention, the improved aromatic separation process can be derived by retrofitting an existing sulfolane-based extraction system. The retrofit is accomplished by converting the original liquid-liquid extraction column into a vapor-liquid service and utilizing it as the top portion of an EDC. The extractive stripping column of the prior art system is used as the lower portion the EDC. Other elements of the prior art system (e.g., water-wash column) can be eliminated. Importantly, the hydraulic capacity of redesigned system will exceed the original capacity of the original system.

In yet further accordance with the improved aromatic recovery process of the present invention, a prior art design glycol-based extraction system can also be retrofitted to employ the improved aromatic recovery system. To accomplish this retrofit, fresh hydrocarbon feedstock is fed into the EDC tower (rather than the main liquid-liquid extractive column) along with lean solvent. The overhead stream from the EDC contains the non-aromatic compound and can bypass the traditional water-washing step. The liquid-liquid extraction column is converted to a liquid-vapor distillation service. The bottom streams from the EDC are routed to the liquid-vapor distillation service and further processed. The overhead extract product is routed directly to product tanks without any additional washing steps.

In yet further accordance with the improved aromatic recovery process and method of retrofitting existing equipment for same, an improvement of the extractive distillation process is obtained by converting original vessels used in the liquid-liquid extractive system into a raffinate extractor, a new EDC, a raffinate water-wash device and an extract recovery operation.

The primary benefits derived from the above-identified embodiments of the improved aromatics recovery process and method for retrofitting existing equipment for same, and variations thereof, can be summarized as follows:

- The embodiments and variations thereof utilize either a stand-alone extractive distillation operation or a hybrid combination including liquid-liquid extraction to provide process gains, such as capacity and recovery;
- All of the embodiments and variations thereof described herein operate without an aromatics (drag) stream or raffinate recycle;
- Each of the embodiments and variations thereof described herein utilize an extractive distillation operation with highly effective solvents and selective addition and/or control of the co-solvent ratio, if present, within the process;
- Many of the embodiments and variations described herein thereof segregate the feedstock and intermediate product streams to gain advantage over limitations present in existing equipment and to improve unit efficiency;
- Many of the embodiments and variations thereof described herein allow for the liquid-liquid extractor operation to be by-passed without shutting down the system to accommodate maintenance work;
- Many of the embodiments and variations thereof described herein can be implemented upon a relatively short interruption of the system so that process tie-ins and other retrofitting operations can be performed;
- All of the retrofit embodiments and variations thereof described herein realize from between a 20% and 100% increase in capacity when compared with the original configuration with a minimum of reconfiguration;
- Many of the embodiments and variations thereof described herein segregate the process streams and direct them to the most desirable processing operation, providing greater recovery of both light and heavy aromatic compounds;
- All of the embodiments and variations thereof described herein optimize conditions for recovery, thus lowering associated operating costs when compared with traditional system designs;
- All of the embodiments and variations thereof described herein more fully utilize the liquid-liquid extraction operation, thus requiring less solvent inventory when compared with prior art process designs; and
- All of the embodiments and variations thereof described herein maintain high levels of purity of the lowest boiling point extracted fraction more easily due to the avoidance of the recycle and associated undesired accumulation of light-weight impurities from the liquid-liquid extraction operation.

From the foregoing, it can be seen that an object of the present invention is to provide an improved aromatic recovery process and method for retrofitting existing equipment for use with an aromatic-containing feedstock and capable of significantly increasing the recovery of aromatics therefrom while avoiding the disadvantages associated with prior art processes and designs. The manner in which these and other objects of the invention are attained may be learned by consideration of the Detailed Description of the invention which follows, together with the accompanying Drawings.

BRIEF DESCRIPTION OF THE DRAWINGS

A more complete understanding of the improved separation process and method of retrofitting existing equipment for same of the present invention may be obtained by reference to the following Detailed Description when taken in conjunction with the accompanying Drawings wherein.

DETAILED DESCRIPTION OF EMBODIMENTS

Process Summary

The present invention relates to the development of an improved aromatics recovery process and method for retrofitting existing equipment for same. Compared with currently-used prior art processes and systems (e.g., sulfolane process, UDEX-type processes, etc.), the present invention provides a process and method for retrofitting existing equipment for running said process which operates without the need for an aromatic recycle (drag) stream or a raffinate recycle and which utilizes with great efficiency superior solvent systems, resulting in overall increased unit efficiency and capacity. Importantly, the present invention is easily employed on prior art systems with a minimum of retrofitting operations and associated down time.

Process Description

The success of the improved aromatics recovery process is based on the development of improvements to various aspects of traditional recovery processes (e.g., sulfolane process, UDEX-type process, etc.). More specifically, the improved aromatics recovery process operates with either a stand-alone extractive distillation operation or a hybrid combination of extractive distillation and liquid-liquid extraction to produce process advantages.

Figure 1:
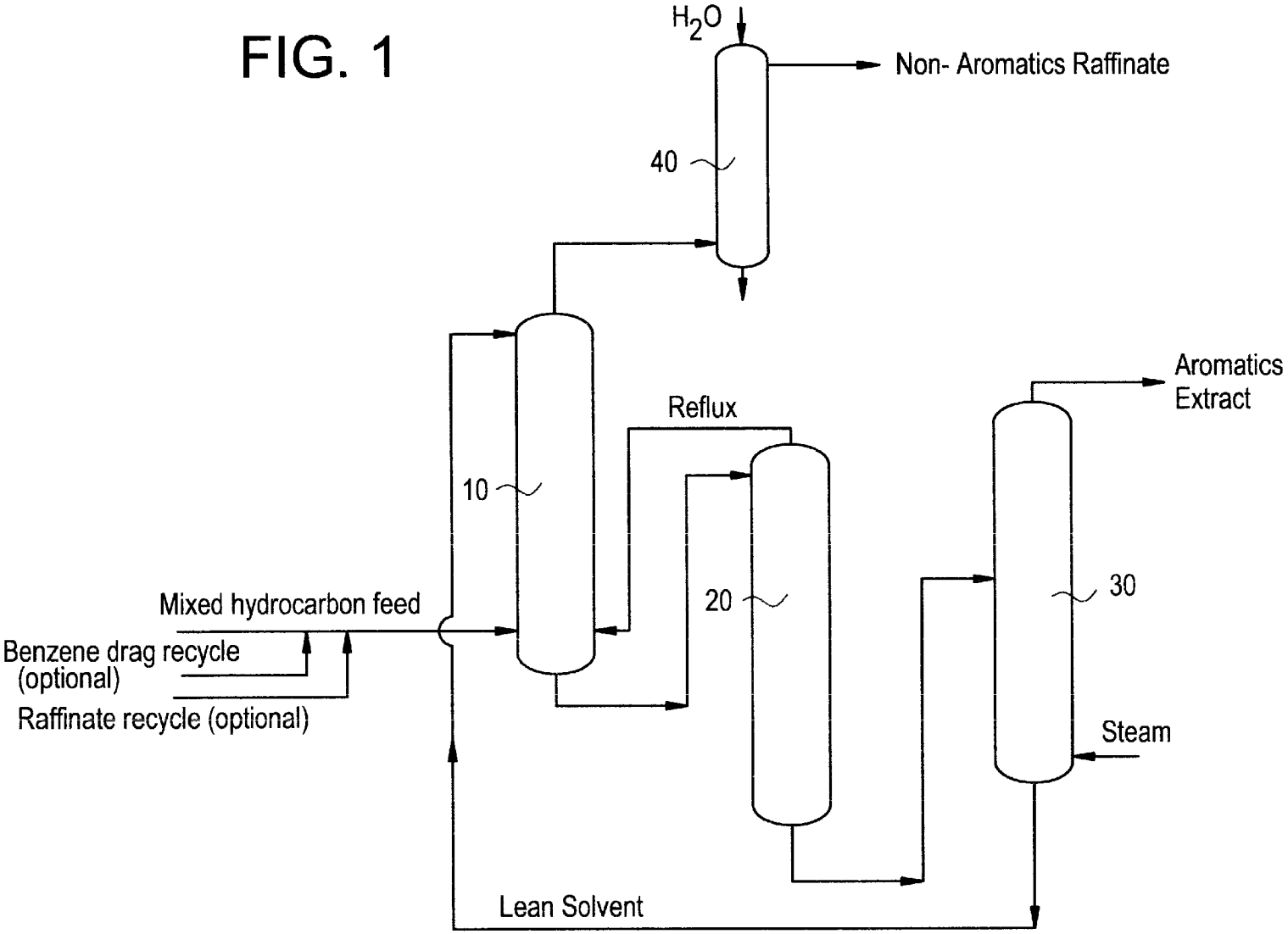
FIG. 1 is a schematic representation of a prior art sulfolane liquid-liquid extraction recovery system.

A prior art sulfolane liquid-liquid extraction recovery system is illustrated in FIG. 1. Such prior art systems are generally comprised of a main extractor 10, an extractive stripper 20, an extract recovery operation 30 and a water-wash system 40. The improved aromatics recovery process and method for retrofitting existing equipment of the present invention was developed by analyzing and improving upon these major components of the system. For example, it was discovered that there is typically substantial surplus hydraulic capacity within the extract recovery operation 30 of these prior art systems. In determining ways in which the prior art system could be modified to improve capacity and efficiency, the inventors focused on three of these four primary components: the main extractor 10, the extractive stripper 20 and the water-wash system 40. It was noted that the although the extractive recovery operation 30 of the system was not typically a limiting aspect, its capacity is easily expanded by modifying a portion or all of the internal components to a lower pressure-drop device combination.

Much more important were modifications to the main extractor 10, the extractive stripper 20 and the water-wash system 40. In the prior art recovery system, a mixed hydrocarbon feedstock is fed to the main extractor 10 for initial processing. The bottom stream from the main extractor 10 is provided to the extractive stripper 20. The top stream from the main extractor 10 is fed to the water-wash system 40. Water is fed to the water-wash system in FIG. 1. Other solvents can be used, if desired. The non-aromatic raffinate from the water-wash system 40 is removed for further processing or sent to storage. The reflux stream from the extractive stripper 20 is recycled back to the lower section of the main extractor 10 for additional processing. The bottom stream from the extractive stripper 20 is routed to the extract recovery operation 30. Steam is added to the extract recovery operation 30 to facilitate recovery of aromatic compounds. Aromatic compounds are removed from the top of the extract recovery operation 30 and the bottom stream (lean solvent) is recycled back to the upper portion of the main extractor 10. An optional benzene drag recycle and raffinate recycle are also illustrated.

Figure 2:
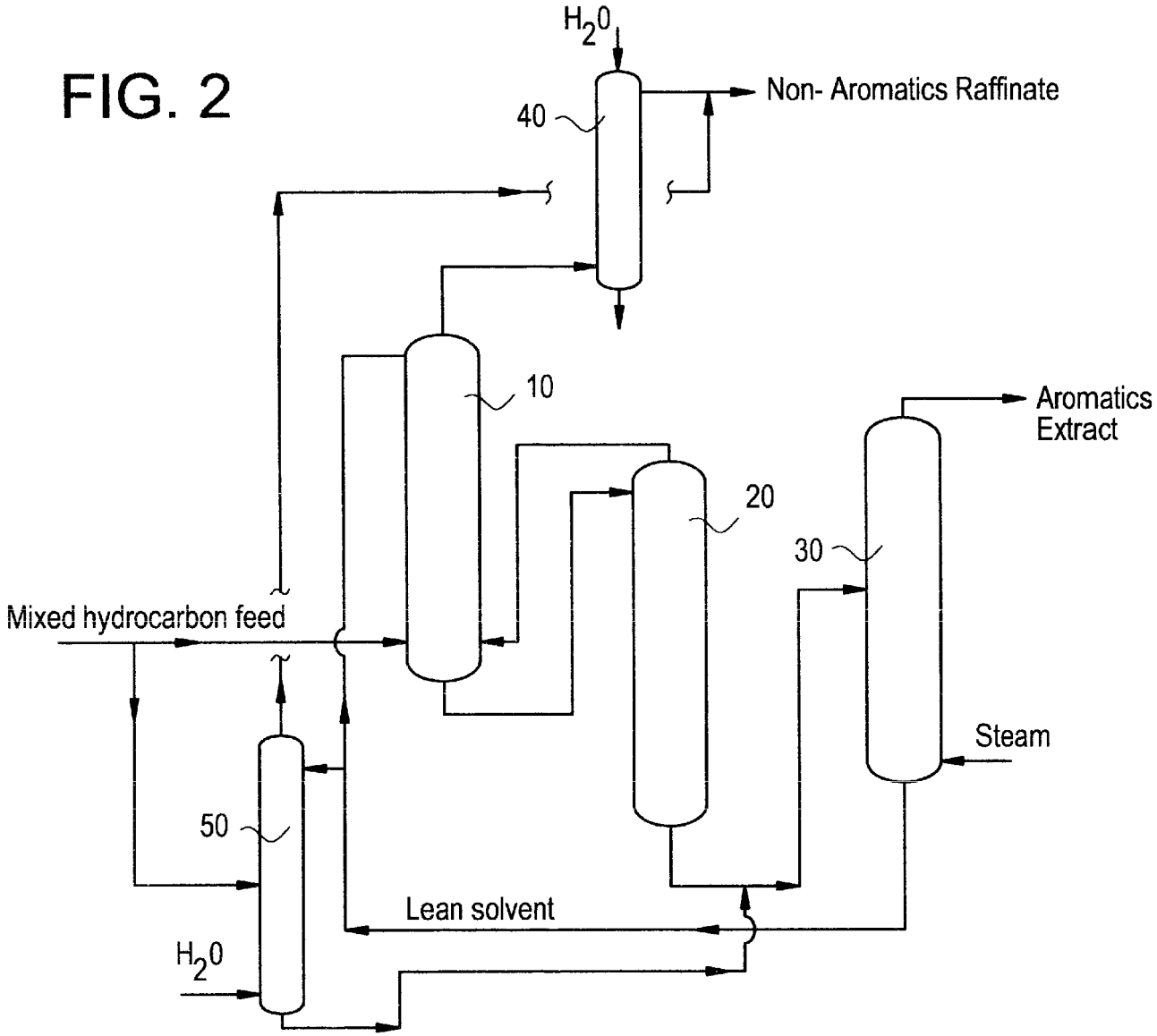
FIG. 2 is a schematic representation of a first embodiment of the improved recovery process of the present invention utilizing a hybrid extraction/extractive distillation design.

Now referring to FIG. 2, there is shown a schematic representation of a first embodiment of the present invention aromatics recovery process. Not unlike the prior art recovery process (FIG. 1), the improved recovery system is comprised of a main extractor 10, an extractive stripper. 20, an extractive recovery operation 30 and a water-wash system 40. However, in contrast to the prior art recovery system (FIG. 1), the improved recovery system of the present invention further comprises a separate extractive distillation column ("EDC") 50. In this hybrid extractive/extractive distillation embodiment, a portion of the hydrocarbon feedstock is routed to the main extractor 10 and a portion of the hydrocarbon feedstock is routed to the EDC 50, which operates in parallel with the extractive operation outlined above. The EDC 50 performs aromatic recovery and purification in a single operation. A portion of the lean solvent leaving the extractive recovery operation 30 is routed to an upper section of the EDC 50. The bottom stream from the EDC 50 is combined with the bottom stream of the extractive stripper 20 and provided to the extract recovery operation 30. The overhead stream from the EDC 50 is directly removed for further processing or sent to storage. Since the effect of the solvent is more pronounced in extractive distillation (compared with liquid-liquid extraction), a co-solvent is added advantageously to the base of the EDC 50 or in combination with the lean solvent to the EDC 50. Although the co-solvent is illustrated as water, it is noted that any suitable co-solvent, or combinations of co-solvents, can be used advantageously with this embodiment.

In normal operation, a co-solvent (e.g., water) is premixed with lean solvent and fed to the upper portion of the EDC 50. The co-solvent concentration decreases as the solvent passes down the EDC 50. Accordingly, co-solvent concentration is highest in the upper portion of the EDC 50 and lowest towards the lower portion of the EDC 50. In order to reverse the co-solvent concentration profile in the EDC 50 and thus boost efficiency, additional co-solvent can be added to the lower portion of the EDC 50, enhancing the selectivity of the co-solvent. Increased efficiency and capacity over the prior art system design are achieved by reducing the bottleneck situation associated with the main extractor 10, the extractive stripper 20 and the raffinate water wash 40 of the prior art system (FIG. 1).

Figure 3:
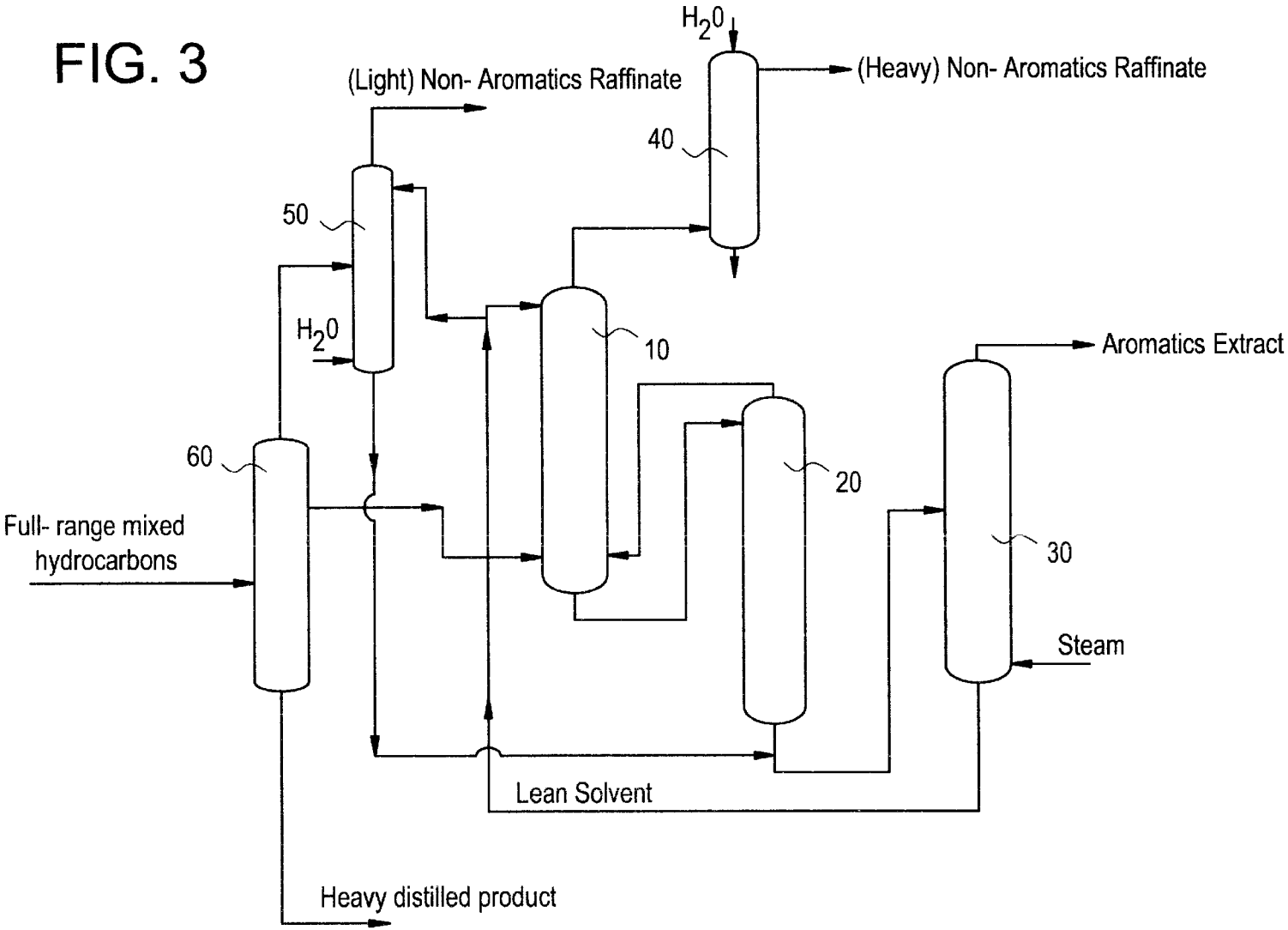
FIG. 3 is a schematic representation of a second embodiment of the improved recovery process of the present invention utilizing a prefractionator and segregation of the feedstock fractions.

A second embodiment of the present invention aromatics recovery process is illustrated in FIG. 3. In this embodiment, the hydrocarbon feedstock is fed to and originates from a prefractionator (e.g., reformate splitter column) 60. Additional advantages are gained by segregating the feedstock fractions and providing one stream to the main extractor 10 and the other stream to the EDC 50. Specifically, a side cut from the prefractionator 60 is provided to the main extractor 10 and an overhead fraction (containing lighter materials) is provided to the EDC 50. As with the first embodiment, selective use of a co-solvent in connection with the EDC 50 may be practiced with this embodiment. Efficiency and capacity are substantially improved with this embodiment since lighter materials are more easily processed in the EDC 50 (as compared with the extractor/stripper operation 10, 20 and 30), and the operation of the EDC 50 is improved due to a narrowed boiling point range for the feedstock. Alternatively, the light raffinate stream from the EDC 50 can be processed in a C5/C6 isomerization unit, and the heavier raffinate stream routed to a naphtha cracker feedstock or gasoline blending process.

Figure 4:
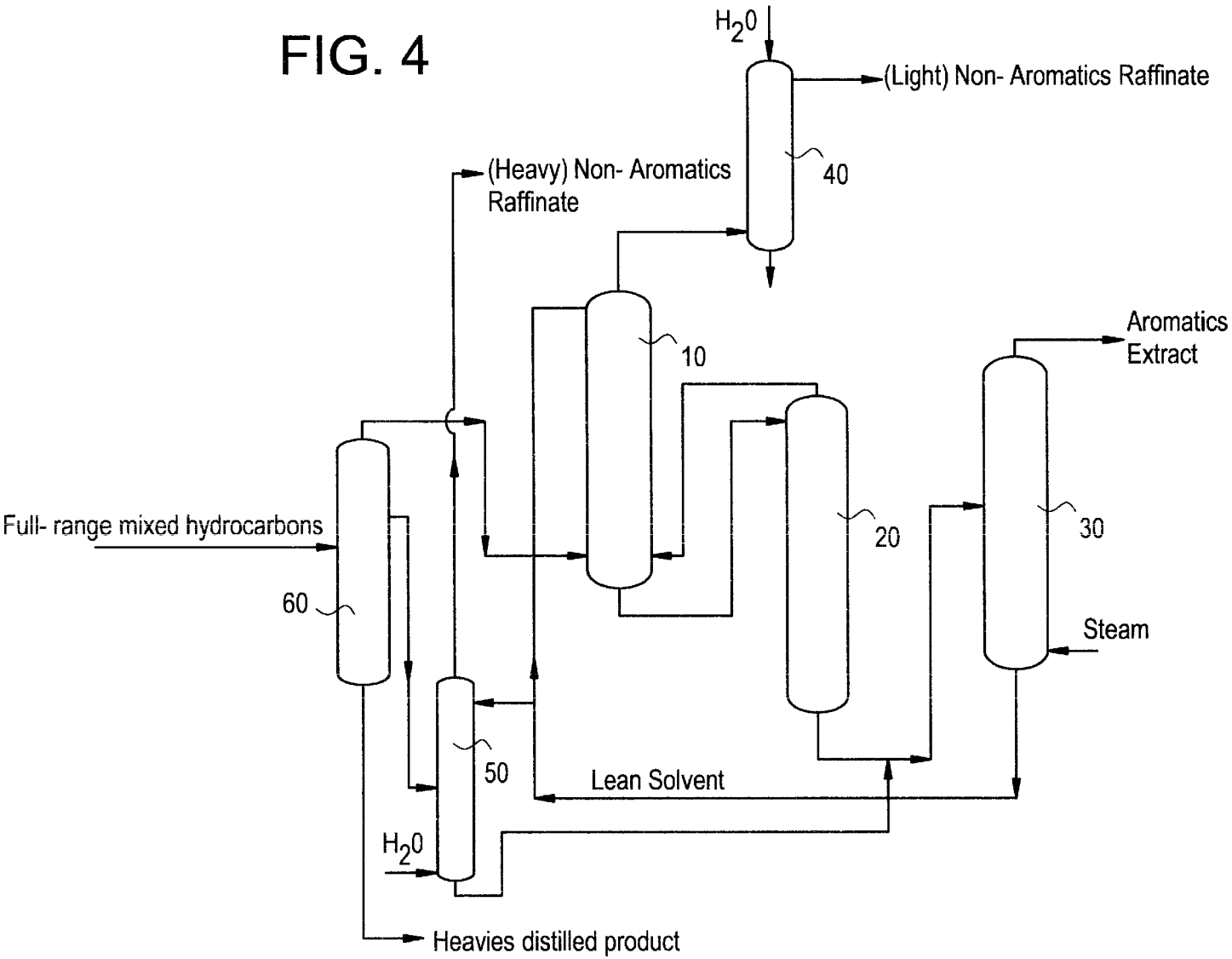
FIG. 4 is a schematic representation of a variation of the second embodiment described above, utilizing a heavy feed to an extractive distillation column.

A variation of the second embodiment described immediately above is illustrated in FIG. 4. In this variation of the second embodiment of the present invention improved aromatics recovery process, a side cut of the mixed hydrocarbon feedstock (including heavier materials) is taken from the prefractionator 60 and provided to the EDC 50 for processing. As with the first variation of the second embodiment, a side cut is also provided to the main extractor 10, extractive stripper 20 and extractor recovery operation 30 of the system for parallel processing. A distinct advantage associated with this variation of the second embodiment is derived from the fact that the heavier aromatics are more completely recovered from feed to the EDC 50 (as compared with the extractor/stripper portion). Since the heavy materials are richer in aromatics (as compared with the lighter materials), the maximum-aromatics limit (described above) reached with the prior art system is avoided. Another benefit associated with this configuration is that an operator is provided with the flexibility to selectively purge a portion of the middle cut of the aromatics fraction into the raffinate by increasing the cutpoint in the EDC 50 (e.g., purge toluene from a BTX range feedstock). This feature can be used to balance production against octane requirements and downstream constraints.

Figure 5:
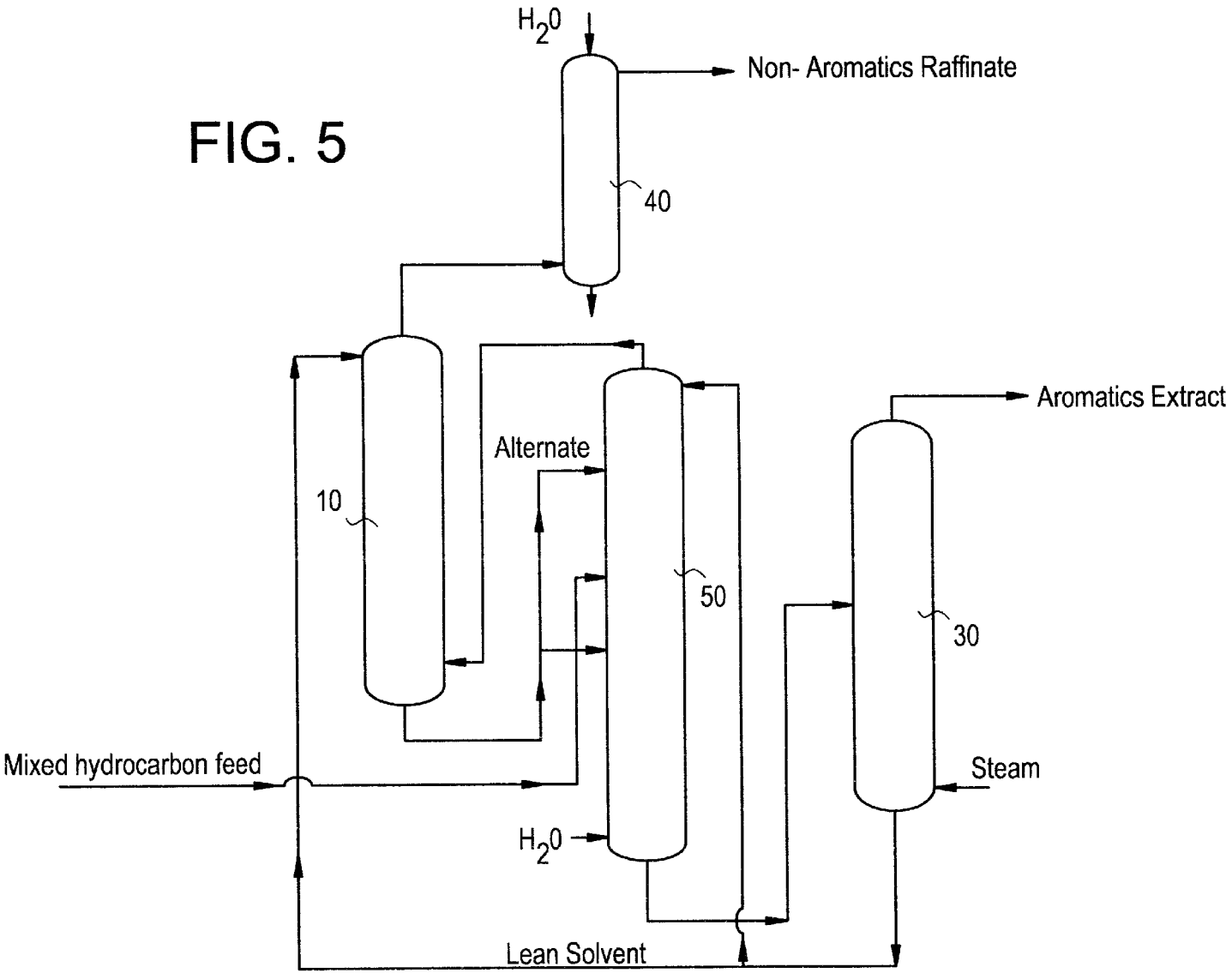
FIG. 5 is a schematic representation of a third embodiment of the improved recovery process of the present invention utilizing a hybrid design with a liquid-liquid extractor operating as a raffinate extractor.

A third embodiment of the improved aromatics recovery process is illustrated in FIG. 5. In this third embodiment, a mixed hydrocarbon feedstock is fed directly to a EDC 50 for processing. An overhead stream is taken from the BDC 50, condensed and subsequently fed to the main extractor 10 for further processing. In this embodiment, the main extractor 10 is operating as a raffinate extractor. A bottom stream from the main extractor 10 is provided alternatively at various points along the EDC 50, placing the benzene-rich fraction in a optimum location for recovery thereof. As discussed in further detail below, the extractive stripper 20 of the prior art design and earlier embodiments may be modified to act as the EDC 50 for this embodiment or the extractive stripper 20 can be replaced with a new vessel for use as the EDC 50. By feeding fresh mixed hydrocarbon feedstock directly into the EDC 50, recovery of xylenes will be maintained while substantially reducing the quantity of aromatics present in the reflux stream from the EDC 50 to the main extractor 10 (operating as a raffinate extractor). Additional efficiency and capacity gains are derived in this embodiment since the stream fed to the main extractor 10 (acting as a raffinate extractor) will be tailored for optimum operation of the liquid-liquid extractor.

Figure 6:
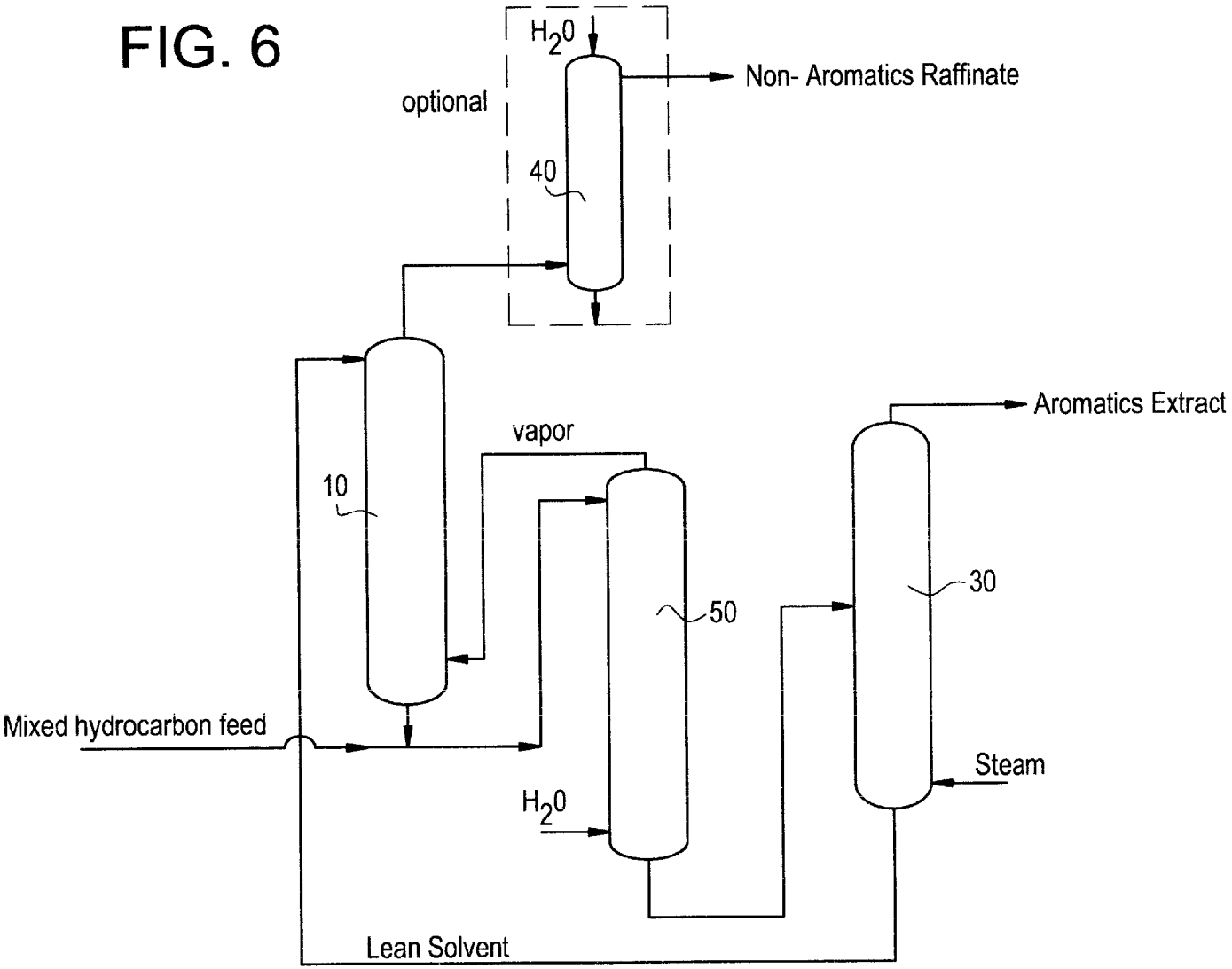
FIG. 6 is a schematic representation of a prior art sulfolane-based extraction system retrofit to run an embodiment of the improved recovery process of the present invention.

FIG. 6 illustrates the retrofit of a prior art sulfolane recovery-type process to run an embodiment of the improved aromatics recovery process of the present invention. In this retrofit operation, the original liquid-liquid extractor is converted into a vapor-liquid service 10 and used as the top portion of an EDC. The original extractive stripper is converted for use as the bottom portion of the EDC 50. The reboiler 52 for the EDC 50 is used in its existing state and the condenser 54 for the original extractive stripper can be used to condense the overhead vapors from the vapor-liquid service 10. In one embodiment, the raffinate water-wash 40 is no longer necessary and can be removed from the system or by-passed, if desired. A distinct advantage to the retrofit illustrated in FIG. 6 is that the hydraulic capacity of the vapor-liquid service 10 and the original extractive stripper operating in series as the EDC 50 is substantially greater than the hydraulic capacity of the original prior art system.

Figure 7A:
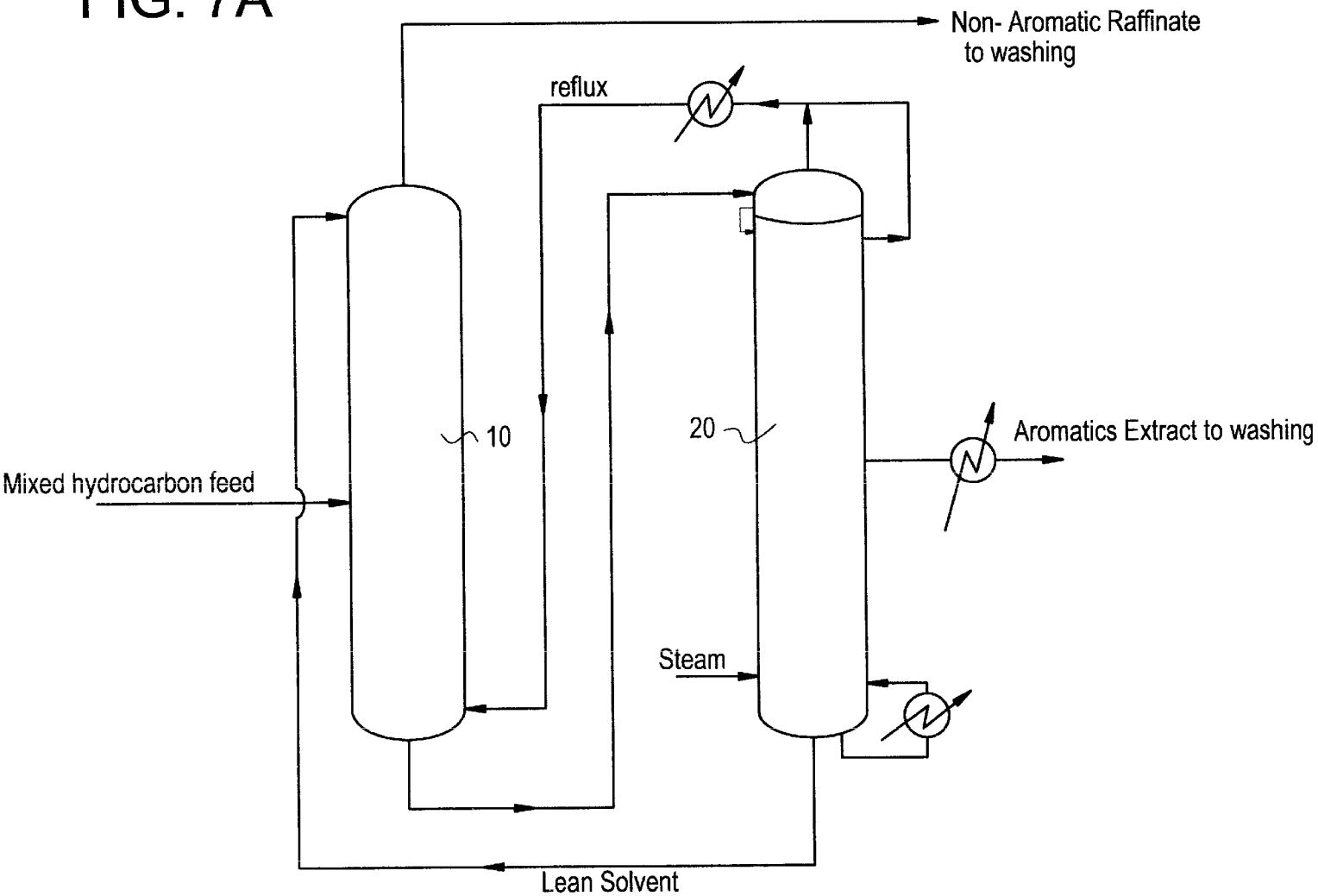
FIGS. 7A and 7 are schematic representations of a prior art glycol-based extraction system and a retrofit of same to run an embodiment of the improved recovery process of the present invention, respectively.
Figure 7B:
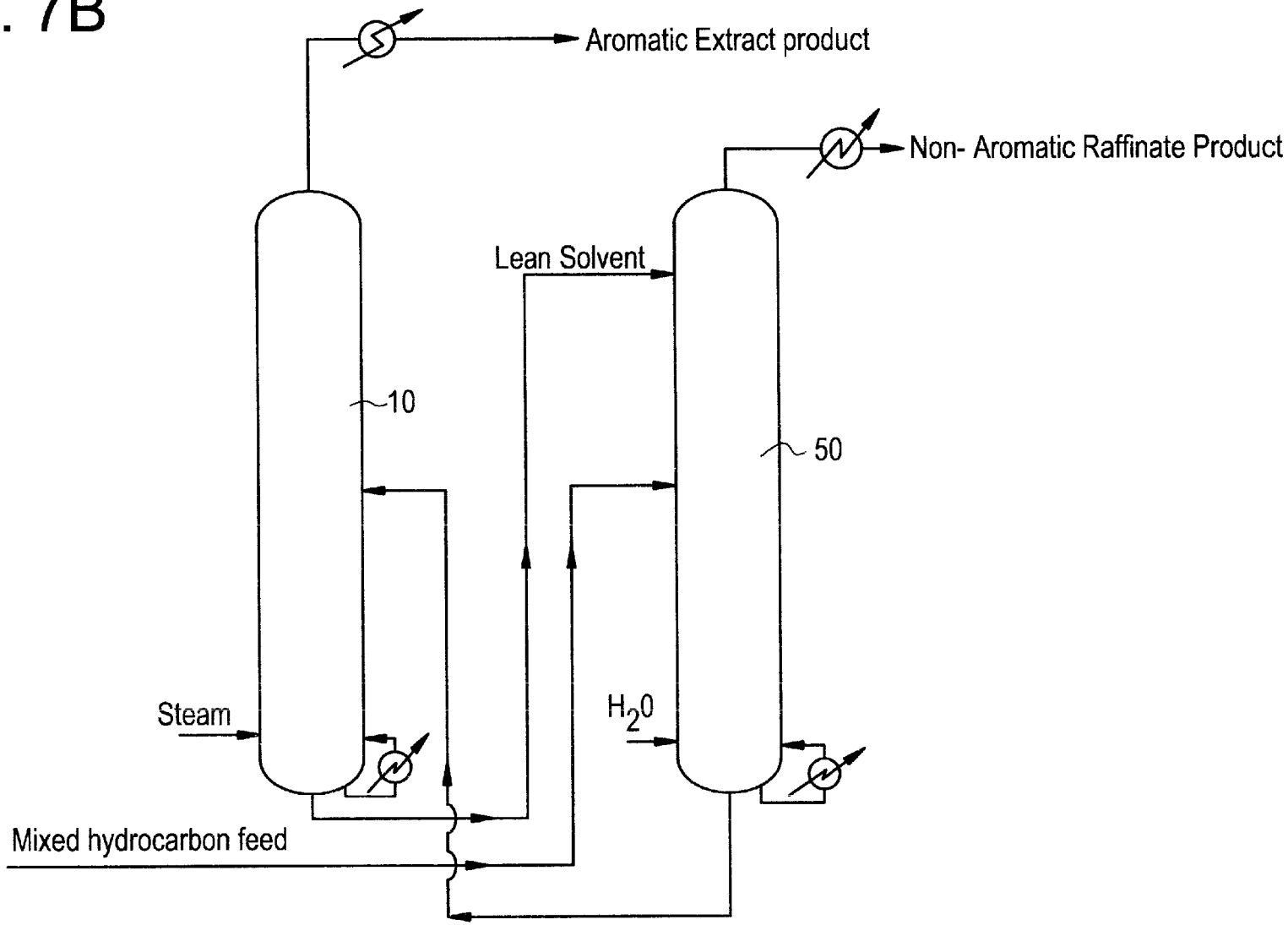

As illustrated in FIGS. 7A and 7B, a prior art glycol-based extraction system can also be easily and economically retrofit to run an embodiment of the improved aromatic recovery process of the present invention. In FIG. 7A, the original glycol-based recovery system is illustrated. In such a system, mixed hydrocarbon feedstock, lean solvent and reflux are fed into a main (liquid-liquid) extractor 10. Rich solvent taken from the bottom of the main extractor 10 is fed into combination extractive stripping/extract recovery column 20. The aromatics are taken via vapor-draw from the extractive stripping/extract recovery column 20 and washed. Lean solvent and reflux are recycled to the main extractor 10.

Now referring to FIG. 7B, a retrofit glycol-based recovery system is illustrated, capable of running an embodiment of the improved aromatics recovery process of the present invention. As retrofitted, a mixed hydrocarbon feedstock and lean solvent are fed into a EDC 50 for processing. The combination extractive stripping/extract recovery column 20 (FIG. 7A) of the original system has been converted to the EDC 50. The overhead stream from the EDC 50 containing the non-aromatics is effectively free of solvent and therefore can bypass a washing step. The bottom stream from the EDC 50 is provided to the extract recovery operation 10, which has been modified from the original liquid-liquid extractor to a liquid-vapor distillation service. The overhead stream from the extract recovery operation 10 is aromatic product and can be collected without a washing step. The conversion described herein is particularly simple and easily carried out since the original extraction unit (FIG. 7A) utilized two condensers and accumulators, which can be conveniently adapted to the new system. The reboilers from the original stripping tower (FIG. 7A) and a water column (not shown)

also can conveniently be reused in the new system. As with the previous processes described herein, a co-solvent or co-solvent system may be added to the base of the EDC 50 or added in combination with the lean solvent to the EDC 50 (FIG. 7B) to improve selectivity of the operation.

Figure 8:
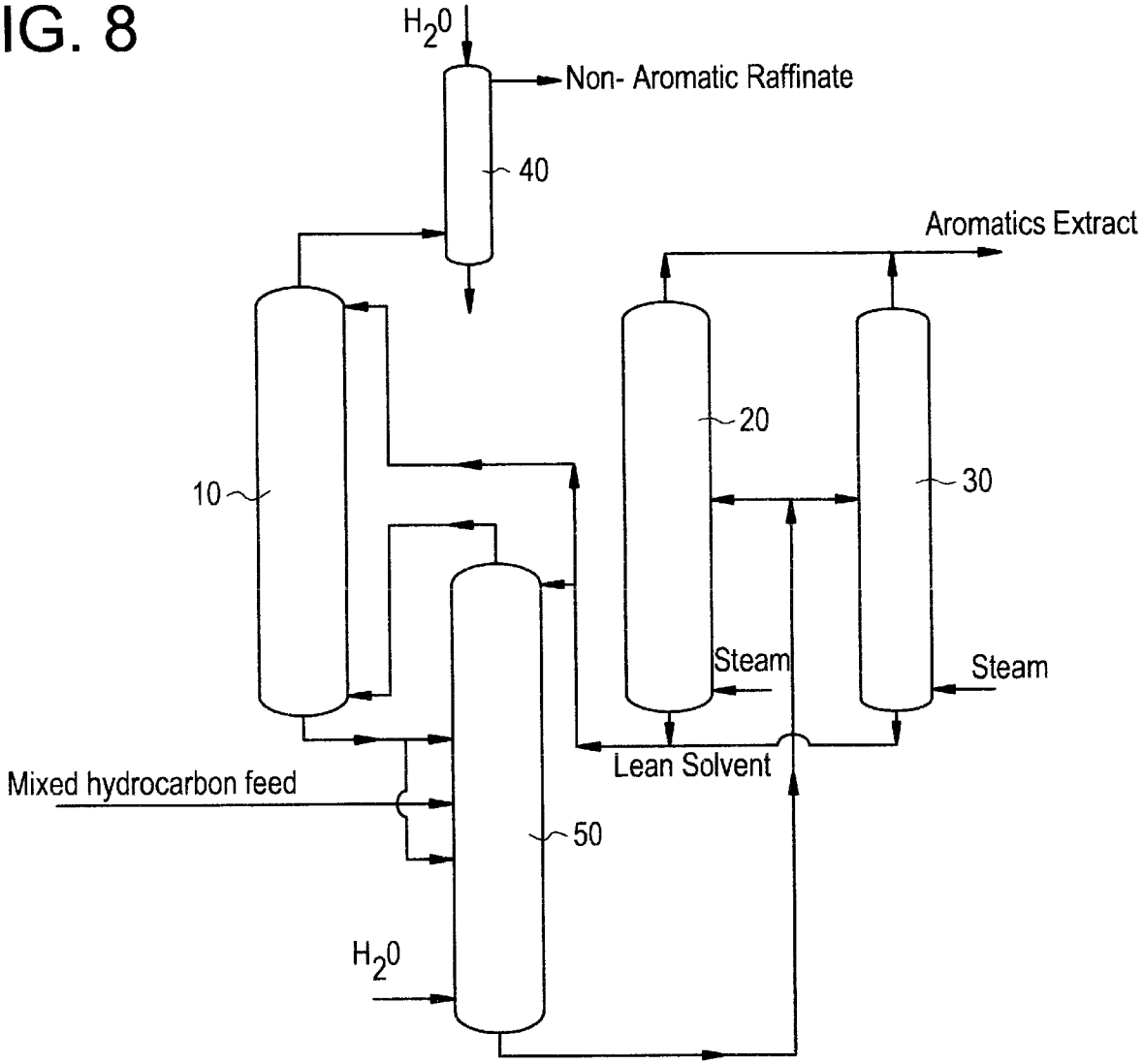
FIG. 8 is a schematic representation of a fourth embodiment of the improved recovery process for same of the present invention, utilizing a hybrid configuration to approximately double extraction unit capacity.

In FIG. 8, a fourth embodiment of the improved aromatics recovery process is illustrated. In this embodiment a hybrid configuration of extractor/extractive distillation is employed. In this embodiment, a mixed hydrocarbon feed and lean solvent are provided directly to an EDC 50 for processing. The bottom stream from the EDC 50 is provided to an extract recovery operation 20 and 30. Aromatic product is taken from the upper portion of the extract recovery operation 20 and 30. Lean solvent from the bottoms of the extract recovery operation 20 and 30 are provided to the EDC 50 and to a raffinate extractor 10. A top stream from the EDC 50 is also provided to the raffinate extractor 10. A top stream from the raffinate extractor 10 is provided to the water-wash device 40 and non-aromatics from the water-washing device 40 are removed for further processing or sent to storage.

An easy and convenient retrofit of the original vessels of a prior art sulfolane process is also possible to run this embodiment of the present invention aromatics recovery process. To reconfigure, original main extractor 10 (FIG. 1) is converted to the raffinate extractor 10. The extractive stripper 20 and the extract recovery operation 30 (FIG. 1) are converted to operate in parallel as the extract recovery operations 20 and 30. The raffinate water-wash 40 (FIG. 1) remains the raffinate water-wash 40 and a new EDC 50 is added. As also illustrated in FIG. 5 and described more fully above, a substantial increase in capacity and efficiency is realized using such a converted system. Importantly, the configuration illustrated in FIG. 8 substantially increases the unit capacity (up to double capacity) through the addition of a single new fractionating column.

Figure 9:
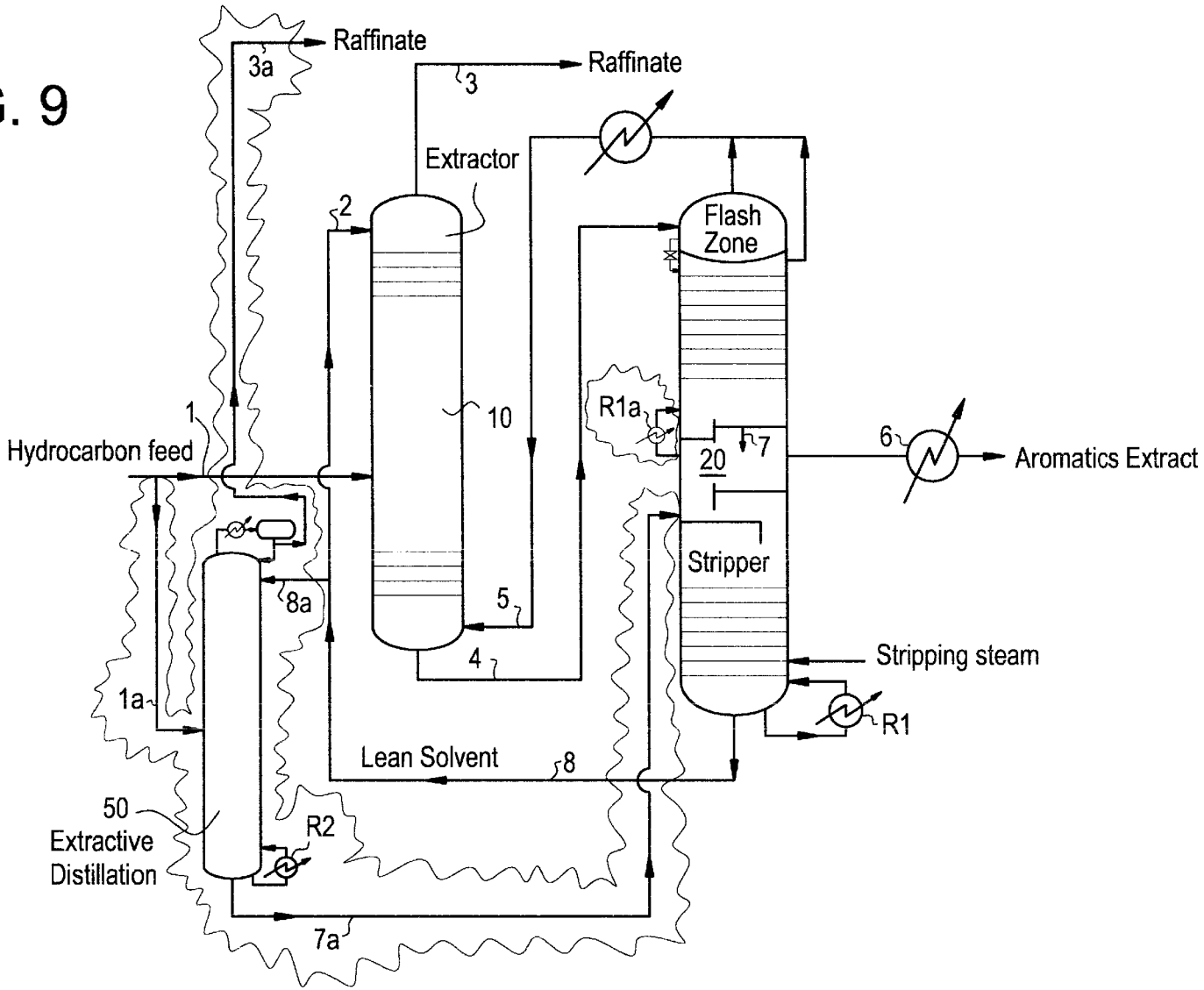
FIG. 9 is a schematic representation of a prior art UDEX-type recovery system retrofit to run an embodiment of the improved recovery process of the present invention.

Now referring to FIG. 9, a retrofit UDEX-type aromatics recovery system is illustrated, capable of running an embodiment of the improved aromatics recovery process of the present invention. For purposes of this disclosure, the term "UDEX", a trade name for a BTX extraction process using mixtures of glycol and water as the extractive solvent, will be used to refer to recovery systems which utilize two (2) major columns to effect the separation of aromatic compounds from a mixture containing aromatic compounds and non-aromatic compounds.

In a basic UDEX system, a mixed hydrocarbon feedstock 1 is fed into the middle or bottom portion of a liquid-liquid extractor column 10 and counter-currently mixed with lean solvent 2, which is fed into the upper section of the liquid-liquid extractor column 10. The lean solvent 2 extracts the aromatics, leaving a raffinate stream 3 lean in aromatics to be taken from the top of the liquid liquid extractor column 10. The rich solvent 4 containing the extraction solvent, aromatics, and some residual non-aromatics exits the liquid-liquid extractor column 10 from the bottom and is routed to the upper portion of a stripper column 20. In the stripper column 20, the stream is typically flashed (in a single stage or multiple stages), the vapors from which are combined with distillate from the lower sections of the stripper column 20 into a reflux stream 5. The reflux stream 5 exits the stripper column 20 towards to the top portion of the column and is condensed and routed back to the liquid-liquid extractor column 10 for further processing. The stripped, lean solvent 7 within the stripper column 20 is taken from the upper section of the stripper column 20 and routed into the lower section of the stripper column 20 for aromatics recovery.

In the lower section of the stripper column 20, the aromatics are stripped from the lean solvent into a vapor draw 6, condensed, and subsequently processed in a washing or finishing step to produce high purity aromatic compounds. Heat is supplied to the stripper column 20 by reboiler R1 and, optionally, by stripping steam added to the bottom of the stripper column 20. The stripped and lean solvent can be cooled by heat exchange or other methods known in the art before it is recycled into the liquid-liquid extractor column 10 to repeat the cycle.

These basic systems are often operated below efficient capacity either due to poor initial design and/or the need to process additional feedstock. Importantly, these UDEX-type recovery systems can be easily and quickly retrofitted to run an embodiment of the present invention improved aromatics recovery process without requiring extensive modifications and the associated down time of more conventional revamp methods. Additionally, in some cases the simple modifications required are reversible, providing an added flexibility to the system and associated equipment.

As retrofitted, a portion of the mixed hydrocarbon feedstock 1*a* is routed into a new extractive distillation column ("EDC") 50, which separates the aromatics from the non-aromatics in a single operation. Lean solvent 8*a* is fed in the upper section of the EDC 50. The water content within the EDC 50 may be controlled by pre-distilling steam 8*a* prior to feeding it to the EDC 50 and/or by removing excess water within the EDC 50 via flashing. The overhead stream 3*a* is condensed and is optionally refluxed in part and routed directly into raffinate storage, or combined with the liquid-liquid extractor column 10 overhead stream 3 and further processed in the raffinate finishing steps. The bottom stream 7*a* of the EDC 50 contains primarily aromatics and solvent and is therefore routed into the lower section of the stripper column 20 for aromatics recovery. Heat is applied to the EDC 50 via reboiler R2.

If desired, the heat load in the stripper column 20 is rebalanced by adding a side reboiler R1*a*. The addition of this feature will permit the stripper overhead vapors to be generated at the midpoint of the stripper column 20 and correspondingly reduce the lower-section vapor and reboiler R1 load. This retrofit design is particularly suited for applications which require very short shut down periods, or where there is an idle column located in close proximity to the UDEX unit.

The following solvents have been found to be useful in the recovery of aromatic petrochemicals and can be employed effectively with the methods of the present invention described herein: tetraethylene glycol, triethylene glycol, diethylene glycol, ethylene glycol, methoxy triglycol ether, diglycolamine, dipropylene glycol, N-formyl morpholine, N-methyl pyrrolidone, sulfolane, 3-methylsulfolane and dimethyl sulfoxide, alone and/or in admixtures with water, and/or in combination with each other and/or water.

| Agent | Solvent:Feed (wt./wt.) | Relative Volatility |
|---|---|---|
| None | 3 | 0.8 |
| Tetraethylene glycol/ methoxy triglycol ether | 3 | 2.2 |
| tetraethylene glycol | 3 | 2.6 |
| NMP | 3 | 2.4 |
| NFM | 3 | 3.0 |
| 2-pyrrolidinone | 3 | 3.1 |
| DMSO | 3 | 3.3 |
| Sulfolane | 3 | 4.0 |

The table above illustrates the enhanced separation of close boiling point components employing selective solvents and the improved methods of the present invention. In this example, the relative volatility between heptane (light-key non-aromatic) and benzene (heavy-key aromatic) is demonstrated. Generally, the higher the relative volatility, the better the aromatic recovery and purity. Relative volatility data are used in computer models to produce process and engineering designs for aromatic separation systems.

Although preferred embodiments of the method and method for retrofitting existing equipment of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A process for recovering aromatic compounds from a mixed hydrocarbon feedstock containing aromatic compounds and non-aromatic compounds of from between 5 and 12 carbons, comprising:

providing a first portion of the mixed hydrocarbon feedstock having a given composition to a liquid-liquid extractor;

providing a second portion of the mixed hydrocarbon feedstock having the same composition as said first portion to an extractive distillation column; and recovering aromatic compounds from the first portion of the mixed hydrocarbon feedstock and from the second portion of the mixed hydrocarbon feedstock via parallel operation of the liquid-liquid extractor and the extractive distillation column.

2. The recovery process of claim 1, wherein the extractive distillation column performs simultaneous recovery and purification of aromatic compounds.

3. The recovery process of claim 1, wherein solvent is provided to an upper portion of the extractive distillation column to increase recovery of aromatic compounds.

4. The recovery process of claim 1, wherein a bottom stream from the liquid-liquid extractor is provided to an extractive stripper for further processing.

5. The recovery process of claim 1, wherein a bottom stream from the extractive distillation column is provided to an extractive recovery operation for further processing.

6. The recovery process of claim 4, wherein the bottom stream from the extractive distillation column is combined with a bottom stream from the extractive stripper prior to being provided to an extractive recovery operation for further processing.

7. The recovery process of claim 1, wherein a non-aromatic containing overhead stream from the extractive distillation column is removed for further processing or sent to storage.

8. The recovery process of claim 3, wherein the solvent is selected from the group consisting of: tetraethylene glycol, triethylene glycol, diethylene glycol, ethylene glycol, methoxy triglycol ether, diglycolamine, dipropylene glycol, N-formyl morpholine, N-methyl pyrrolidone, sulfolane, 3-methylsulfolane, dimethyl sulfoxide and mixtures thereof.

9. The recovery process of claim 3, wherein the solvent is one or more of the following: tetraethylene glycol, triethylene glycol, diethylene glycol, ethylene glycol, methoxy triglycol ether, diglycolamine, dipropylene glycol, N-formyl morpholine, -methyl pyrrolidone, sulfolane, 3-methylsulfolane and dimethyl sulfoxide.

10. The recovery process of claim 3, wherein a co-solvent is provided to the recovery process to increase recovery and purity of recovered aromatic compounds.

11. The recovery process of claim 10, wherein the co-solvent is provided to a lower portion of the extractive distillation column to increase selectivity of the co-solvent.

12. The recovery process of claim 10, wherein the co-solvent contains water.

13. The recovery process of claim 1, wherein solvent is provided to the extractive distillation column to increase recovery of aromatic compounds.

14. The recovery process of claim 13, wherein the solvent is selected from the group consisting of: tetraethylene glycol, triethylene glycol, diethylene glycol, ethylene glycol, methoxy triglycol ether, diglycolamine, dipropylene glycol, N-formyl morpholine, N-methyl pyrrolidone, sulfolane, 3-methylsulfolane and dimethyl sulfoxide.

15. The recovery process of claim 13, wherein the solvent is one or more of the following: tetraethylene glycol, triethylene glycol, diethylene glycol, ethylene glycol, methoxy triglycol ether, diglycolamine, dipropylene glycol, N-formyl morpholine, -methyl pyrrolidone, sulfolane, 3-methylsulfolane and dimethyl sulfoxide.

16. The recovery process of claim 13, wherein a co-solvent is provided to the recovery process to increase recovery of aromatic compounds and purity of recovered said aromatic compounds.

17. The recovery process of claim 1, wherein a light raffinate stream produced by a recovery process is further processed via an isomerization unit.

18. The recovery process of claim 1, wherein a heavy raffinate stream produced by the recovery process is further processed via naphtha cracking.

19. A process in accordance with claim 1 in which said mixed hydrocarbon feedstock is fed in a single stream and in which said first portion and said second portion of the same composition are obtained by dividing said single feedstock stream.

* * * * *

UNITED STATES PATENT AND TRADEMARK OFFICE

CERTIFICATE OF CORRECTION

PATENT NO. : 6,565,742 B1
DATED : May 20, 2003
INVENTOR(S) : Gentry et al.

It is certified that error appears in the above-identified patent and that said Letters Patent is hereby corrected as shown below:

Column 2,
Line 24, delete "recover" and insert -- recovery --.
Line 33, delete "5 and 6" and insert -- C5 and C6 --.

Column 5,
Line 29, delete "and 7" and insert -- and 7B --.

Column 7,
Line 65, delete "BDC" and insert -- EDC --.

Column 8,
Line 4, delete "in a" and insert -- in an --.
Line 52, delete “a” and insert -- an --.

Column 9,
Line 52, delete "liquid liquid" and insert -- liquid-liquid --.

Column 12,
Lines 11 and 34, delete "-methyl pyrrolidone" and insert -- N-methyl pyrrolidone --.

Signed and Sealed this

Seventh Day of October, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,565,742 B1
DATED : May 20, 2003
INVENTOR(S) : Gentry et al.

It is certified that error appears in the above-identified patent and that said Letters Patent is hereby corrected as shown below:

Column 4,
Line 54, add -- , -- after "easily."

Column 8,
Line 1, delete "operating" and insert -- operated --.
Line 7, add -- , -- after "embodiment."

Signed and Sealed this

Twenty-fifth Day of November, 2003

JAMES E. ROGAN
*Director of the United States Patent and Trademark Office*